US005396065A

United States Patent [19]

Myerholtz et al.

[11] Patent Number: 5,396,065

[45] Date of Patent: Mar. 7, 1995

[54] SEQUENCING ION PACKETS FOR ION TIME-OF-FLIGHT MASS SPECTROMETRY

[75] Inventors: Carl A. Myerholtz, Cupertino; Richard L. Baer, Los Altos; Christian A. Le Cocq, Palo Alto, all of Calif.

[73] Assignee: Hewlett-Packard Company, Palo Alto, Calif.

[21] Appl. No.: 171,076

[22] Filed: Dec. 21, 1993

[51] Int. Cl.[6] ..... H01J 49/40

[52] U.S. Cl. ..... 250/287; 250/282

[58] Field of Search ..... 250/287, 286, 282

[56] References Cited

U.S. PATENT DOCUMENTS

| | | | |
|---|---|---|---|
| 4,458,149 | 7/1984 | Muga | 250/287 |
| 4,778,993 | 10/1988 | Waugh | 250/287 |
| 4,983,831 | 1/1991 | Migeon et al. | 250/309 |
| 5,073,713 | 12/1991 | Smith et al. | 250/287 |
| 5,196,708 | 3/1993 | Mullock | 250/423 R |
| 5,331,158 | 7/1994 | Dowell | 250/287 |

OTHER PUBLICATIONS

Copley, J. R. D., "Optimized Design of the Chopper Disks and the Neutron Guide in a Disk Chopper Neutron Time-of-Flight Spectromester," *Nuclear Instruments and Methods in Physics Research,* A291 (1990), pp. 519–532.

Kinsel, Gary R. et al., "Post Source Pulse Focusing: A Simple Method to Achieve Improved Resolution in a Time-of-Flight Mass Spectrometer," *International Journal of Mass Spectrometry and Ion Processes,* 91 (1988), pp. 157–176.

Skold, K., "A Mechanical Correlation Chopper for Thermal Neutron Spectroscopy," *Nuclear Instruments and Methods,* 63 (1968), pp. 114–116.

Wilhelmi, G. et al., "Binary Sequences and Error Analysis for Pseudo-Statistical Neutron Modulators with Different Duty Cycles," *Nuclear Instruments and Methods,* 81 (1970), pp. 36–44.

*Primary Examiner*—Jack I. Berman

[57] ABSTRACT

A method and apparatus for analyzing ions by determining times of flight include establishing an encoded sequence for launching packets of ions from a source region toward a detector. The encoded sequence is one in which the high-mass ions of a leading packet will be passed by the low-mass ions of a trailing packet. Thus, a high efficiency time-of-flight mass spectrometer is formed. The ions of each packet are acted upon to bunch the ions of the packet, thereby compensating for initial space and/or velocity distributions of ions in the launching of the packet. The times of arrival of the ions are determined at the detector to obtain a signal of overlapping spectra corresponding to the overlapping launched packets. A correlation between the overlapping spectra and the encoded launch sequence is employed to derive a single non-overlapped spectrum.

15 Claims, 4 Drawing Sheets

SEQUENCING ION PACKETS FOR ION TIME-OF-FLIGHT MASS SPECTROMETRY

TECHNICAL FIELD

This invention relates generally to ion analysis and more particularly to ion time-of-flight mass spectrometry.

BACKGROUND ART

Ions which have the same initial kinetic energy but different masses will separate when allowed to drift down a field free region. This is a basic principle of typical time-of-flight mass spectrometers. Ions are conventionally extracted from an ion source in small packets. The ions acquire different velocities according to the mass-to-charge ratio of the ions. Lighter ions will arrive at a detector prior to high-mass ions. Determining the time of flight of the ions across a propagation path permits the determination of the masses of different ions. The propagation path may be circular or helical, as in cyclotron resonance spectrometry, but typically linear propagation paths are used for chromatography mass spectrometry applications.

Time-of-flight mass spectrometry is used to form a mass spectrum for ions contained in a sample of interest. Conventionally, the sample is divided into packets of ions that are launched along the propagation path using a pulse-and-wait approach. In releasing packets, one concern is that the lighter and faster ions of a trailing packet will pass the heavier and slower ions of a preceding packet. Using the traditional pulse-and-wait approach, the release of an ion packet is timed to ensure that the ions of a preceding packet reach the detector before any overlap can occur. Thus, the periods between packets is relatively long. If ions are being generated continuously, only a small percentage of the ions undergo detection. A significant amount of sample material is thereby wasted. The loss in efficiency and sensitivity can be reduced by storing ions that are generated between the launching of individual packets, but the storage approach carries some disadvantages.

Resolution is an important consideration in the design and operation of a mass spectrometer for ion analysis. The tradition pulse-and-wait approach in releasing packets of ions enables resolution of ions of different masses by separating the ions into discernible groups. However, other factors are also involved in determining the resolution of a mass spectrometry system. "Space resolution" is the ability of the system to resolve ions of different masses despite an initial spatial position distribution within an ion source from which the packets are extracted. Differences in starting position will affect the time required for traversing a propagation path. "Energy resolution" is the ability of the system to resolve ions of different mass despite an initial velocity distribution. Different starting velocities will affect the time required for traversing the propagation path. Outside of the realm of ion analysis, continuous neutron beams have been modulated by mechanical choppers to increase the "on" time beyond a pulse-and-wait approach. See for example, (1) K. Skold, "A Mechanical Correlation Chopper for Thermal Neutron Spectroscopy," *Nuclear Instruments and Methods,* 63 (1968), pages 114–116; (2) G. Wilhelmi et al., "Binary Sequences and Error Analysis for Pseudo-Statistical Neutron Modulators with Different Duty Cycles," *Nuclear Instruments and Methods,* 81 (1970), pages 36–44; and (3) J. R. D. Copley, "Optimized Design of the Chopper Disks and the Neutron Guide in a Disk Chopper Neutron Time-of-Flight Spectrometer," *Nuclear Instruments and Methods in Physics Research,* A291 (1990), pages 519–532. The mechanical choppers release pulses of neutrons at a frequency greater than that of a pulse-and-wait approach, but the technique does not address space resolution or velocity resolution. The resolution of the system is controlled by the longest pulse used in the sequence. Moreover, it is believed that increases in the duty cycle beyond the pulse-and-wait approach are soon accompanied by a susceptibility of the system to reaching an unacceptably low level of sensitivity to low-concentration neutrons.

What is needed is a method and apparatus for analyzing ions such that increased efficiency is accompanied by increased sensitivity to low-concentration ions of a sample of interest.

SUMMARY OF THE INVENTION

The invention meets this need by releasing packets of ions along a propagation path in a pseudo-random sequence and acting upon each packet to bunch the ions in the packet. The launching of the packets of ions is in accordance with an encoded sequence in which adjacent packets overlap prior to reaching a detector. Thus, the efficiency of the method and apparatus is greater than the efficiency achieved by the traditional pulse-and-wait approach. The bunching of the ions in each packet is for the purpose of compensating for initial variations in space distribution and/or velocity distribution at the launching of the packet. Where the packets are electrically launched during pulses of a signal, the bunching of ions creates an environment in which the packets appear to be edge-triggered with each pulse.

The release of packets is preferably "pseudo-irregular," i.e. within a definite arithmetic process but without a regular spacing between releases. Optimally, the release sequence is a pseudo-random noise sequence, since such a sequence provides advantages in data recovery. In all embodiments of the invention, at least some of the packets will overlap prior to reaching the detector. That is, low-mass ions of a trailing packet will arrive at the detector prior to high-mass ions of a preceding packet.

The times of arrival of ions at the detector are ascertained to obtain a signal corresponding to overlapping times-of-arrival spectra for the launched packets. A process of correlating the overlapping spectra with the encoded sequence for launching the packets is then employed to derive a non-overlapped spectrum that can be employed to obtain data regarding the ions within the packets.

The encoded pseudo-irregular sequence is preferably a return-to-zero code having substantially identical durations of non-zero pulses. Thus, each packet is substantially identical to preceding and subsequent packets. The packets are preferably released electronically by channeling a signal to an extraction grid, but mechanical chopping devices may also be employed. The bunching of ions of each packet may be accomplished by any of a number of means. U.S. Pat. No. 4,778,993 to Waugh describes space focusing, energy focusing and momentum focusing to compensate for initial variations in kinetic energy of ions. Space focusing provides compensation by applying a linear electric field which accelerates the ions according to their mass-to-charge ratio. Energy focusing applies a toroidal electrostatic field, so that ions of equal mass/charge travel equal flight times, with those of higher energy traveling longer distances in the field. Momentum focusing employs a magnetic sector field. Also known is linear mass reflection in which ions traverse a linear region wherein compensation for differing energies is achieved by reflecting the ions through 180 degrees in a system of electrostatic fields.

One advantage of this invention is that a greater percentage of a sample can be analyzed without requiring ion storage. The resulting increase in efficiency improves the signal-to-noise ratio of the system and the sensitivity of the system to ions having a low concentration within the sample of interest. Moreover, the dynamic range demands of the data acquisition circuitry are reduced.

Another advantage of the invention is that if the release of ion packets is electronically achieved, the code sequence can be changed quickly and easily, even during the course of an experiment. The method and apparatus is not limited with respect to ionization techniques. For example, the method may be used with electron impact, chemical ionization, field ionization, atmospheric pressure ionization, glow discharge, thermospray, fast atom bombardment, and electrospray.

DETAILED DESCRIPTION

Figure 1:
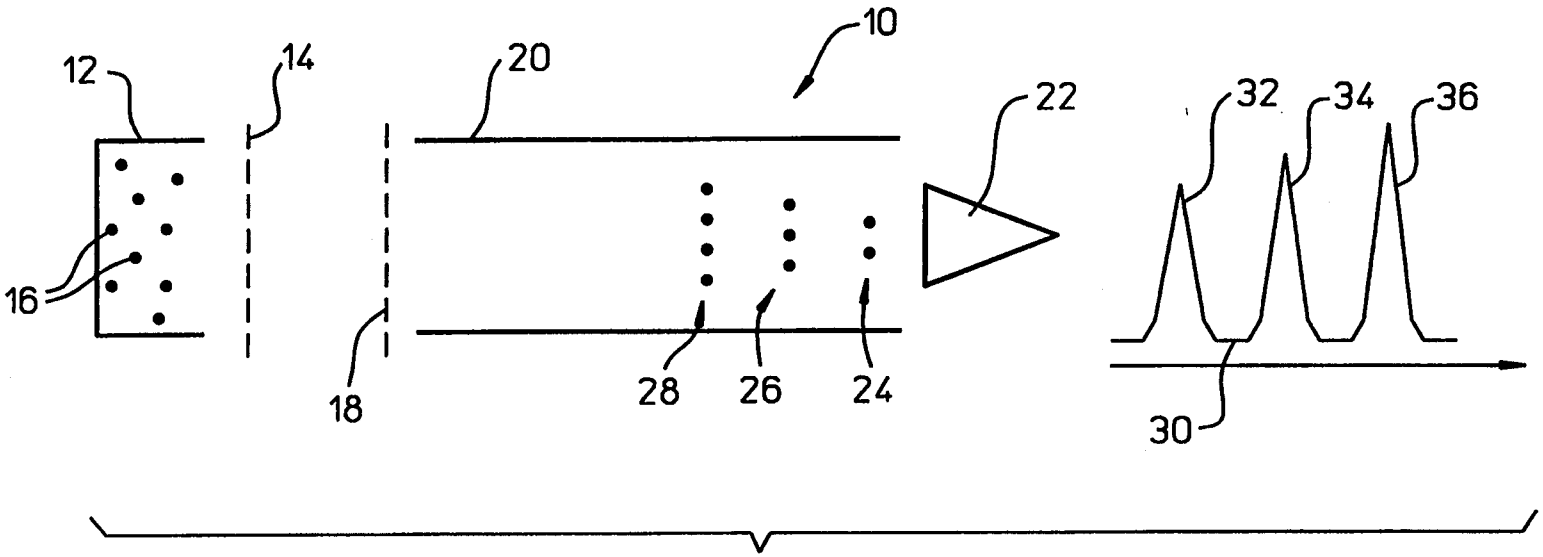
FIG. 1 (PRIOR ART)
FIG. 1 is a schematical view of a prior art time-of-flight mass spectrometer.

With reference to FIG. 1, a traditional time-of-light mass spectrometer 10 is shown as including an ion source 12. An extraction grid 14 is employed to release ions 16. While not critical, an orthogonal pulsing technique may be employed in which a signal to the extraction grid releases packets of ions by breaking a continuous ion beam up into pulses traveling in a direction orthogonal to the ion beam. A typical voltage applied to the extraction grid may be 200 to 300 volts.

An entrance grid 18 is connected to an external voltage control, not shown, for providing an electric potential level for allowing or preventing ions from entering a containment 20 that establishes a field free region to a detector 22. The potential level of the entrance grid is approximately 0 volts.

In operation, the time-of-flight mass spectrometer 10 launches ions 16 from the ion source 12. The duration of a pulse for launching ions into the field free region of the mass spectrometer may be one microsecond. The ions released during the one microsecond pulse will drift along the propagation path of the field free region, but ions of different masses will separate. Lighter ions will reach a greater velocity than heavier ions. In FIG. 1, the sample of interest is shown as including three constituents of different concentrations. A first constituent is represented by two ions 24. A second constituent 26 represents ions having a greater concentration and a greater mass than the ions of the first constituent. Furthest from the detector 22 is a third constituent of ions 28 having greater mass and a higher concentration.

Figure 2:
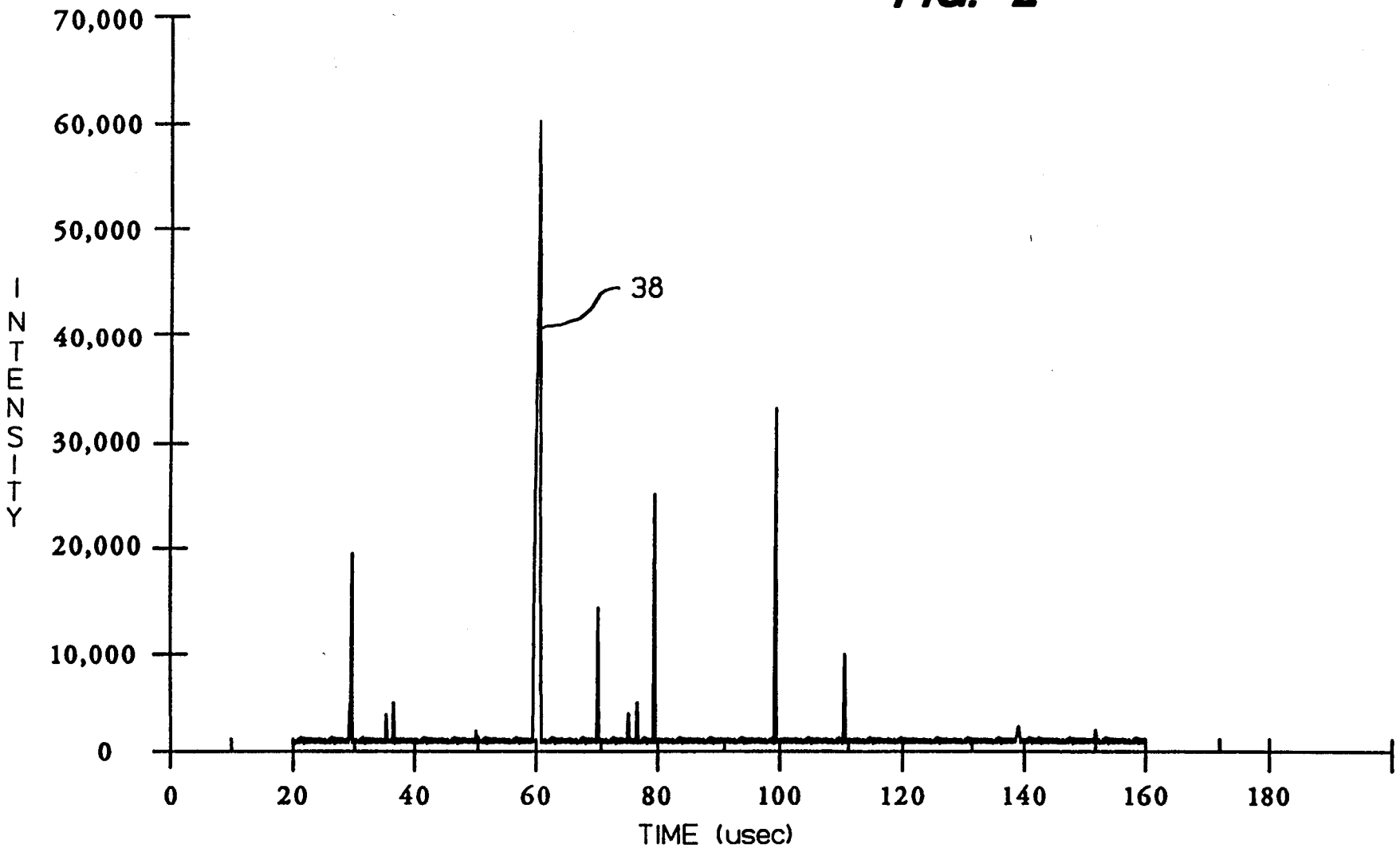
FIG. 2 (PRIOR ART)
FIG. 2 is a graphical view of a mass spectrum obtained by operation of the mass spectrometer of FIG. 1.

As the constituents 24, 26 and 28 reach the detector 22, an electrical signal is generated corresponding to the intensity of the ions. Such a time/intensity signal is shown at 30, wherein peaks 32, 34 and 36 represent the concentration of ions of the constituents 24, 26 and 28, respectively. A more accurate time/intensity signal 38 of a time-of-flight mass spectrometer is shown in FIG. 2. The signal 38 is a typical mass spectrum of the compound perfluorotributylamine (PFTBA).

The signals, or spectrums 30 and 38, of FIGS. 1 and 2 are obtained by launching discrete packets of ions from the ion source 12. A second packet is launched only after a sufficient time to ensure that lighter ions of the second packet will not overtake the heavier ions of the first packet. This can require hundreds of microseconds, depending on the system configuration. Where the wait period is 200 microseconds and the launch pulse is 1 microsecond, the mass spectrometer 10 will have a duty cycle of only 1:200. As a result, only 0.5 percent of the ions will be subject to detection if the ions are being generated continuously. A significant amount of information is thereby lost, unless ion storage techniques are utilized.

Figure 3:
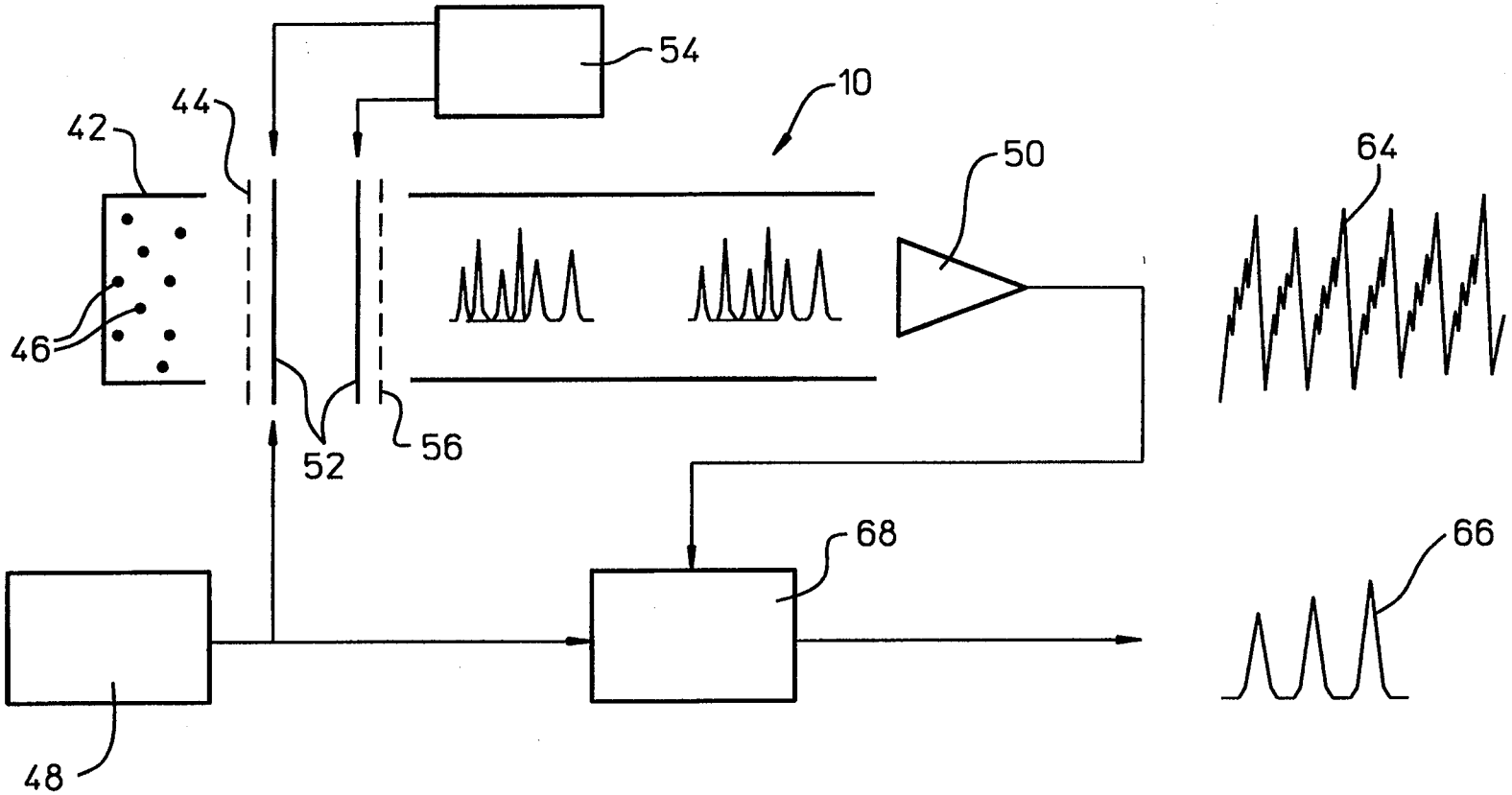
FIG. 3 is a schematical view of a time-of-flight mass spectrometer in accordance with the invention.

A more efficient time-of-flight mass spectrometer 40 is shown in FIG. 3. The increased efficiency is obtained without ion storage, although ion storage techniques may be utilized to further improve the performance of the system. By increasing the efficiency, the signal-to-noise ratio of the system is improved, thereby increasing the sensitivity of the system to low concentration constituents of a sample of interest.

The mass spectrometer 40 includes an ion source 42 and an extraction grid 44 of the type described with reference to FIG. 1. In its preferred embodiment, the ion source 42 continuously generates ions 46. An orthogonal pulsing technique is preferably employed of the type previously described by M. Guilhaus. In addition to breaking a continuous ion beam up into pulses traveling orthogonal to the direction of the ion beam, this approach offers advantages for time-of-flight applications. Since a segment of the beam is pulsed out each time, it takes some time to fill the pulsing volume with ions. This effectively provides some ion storage. If the ions have sufficient energy, the refill time can be less than 10 microseconds. The high speed pulsing rate of the modulation encoding approach to be described below enables such a system to be pulsed shortly after the pulsing volume has been refilled. While this is the preferred embodiment, other approaches may be used. The beam chopping is preferably electrically actuated, but mechanical beam choppers may be utilized.

Rather than the pulse-and-wait approach described with reference to FIG. 1, the mass spectrometer 40 of FIG. 3 includes a pulse time encoder 48 that provides a control signal to the extraction grid 44 to release packets of ions at intervals which cause some overlap of packets with approach to a detector 50. Preferably, the encoded sequence for releasing packets is a pseudo-irregular sequence. Optimally, the timing pattern is a pseudo-random noise sequence, but other codes may be utilized, e.g., golay codes.

In a digital context, a pseudo-random code is structured as a sequence of digital words or sequences such that each possible word is as likely to occur as any other. The power spectrum of such a code (equivalent to its probability distribution) is discrete but is substantially "flat" that is of constant amplitude for each non-zero frequency component of the Fourier transform of the code. As such, the pseudo-random code is a finite, digital approximation of "white noise." The concept of pseudo-randomness is well understood in the art of digital encoding.

In one well-known pseudo-random code, which uses maximal length sequences (with words lengths equal to Mersenne prime numbers such as seven and thirty-one), the words are cyclical permutations of each other and each word is uncorrelated with any other. The discrete spectrum of this code is essentially flat up to the frequency of repetition. Because the code words are uncorrelated, this code is well suited for time-off-light applications such as this invention, in which the encoded sequence is corrupted by noise and possible overlapping and is extracted at a downstream location, for example, using known deconvolution techniques. Pseudo-random sequencing is thus preferred, since it is characterized by properties which aid in eliminating side lobes, thereby improving data recovery. As is mentioned above, however, other classes of codes, such as Golay codes, may also be used.

Pseudo-random noise sequencing will provide an average duty cycle of approximately 50 percent. (If a "one" is about as likely as a "zero" then the average or expected level is roughly: $\frac{1}{2}\cdot 1+\frac{1}{2}\cdot 0=0.5$, which corresponds to 50%.) The packets are released and are individually acted upon by plates 52 that cause bunching of ions within an individual packet. The voltages of the plates are dependent upon a voltage source 54. The plates act as a parallel plate capacitor which allows passage of ions. The voltages applied to the plates are selected to cause ions at the trailing edge of a pulse to receive a greater energy impulse than ions at the leading edge of the pulse. Ideally, the ions reach an entrance grid 56 simultaneously, so that the ions of a particular packet are effectively edge triggered by a pulse from the encoder 48. The bunching of ions is an important aspect of the invention, since resolution of the time-of-flight analysis is no longer limited by the means for launching and channeling ions. The bunching of ions compensates for spaced distribution of ions within a packet released from the ion source 42. Moreover, the bunching compensates for the velocity distribution of ions within a packet. The lower limits of resolution of the time-of-flight analysis are not set by the duration of pulses, but rather by the capabilities of the detector 50 and downstream electronic circuitry.

The bunching of ions in FIG. 3 is shown as being provided by the plates 52 and the voltage source 54. Other known techniques for creating more compact packets may be used. For example, space focusing, energy focusing and momentum focusing may be employed to provide compensation for initial variations in the spacing and the velocity of ions within a packet.

Figure 4:
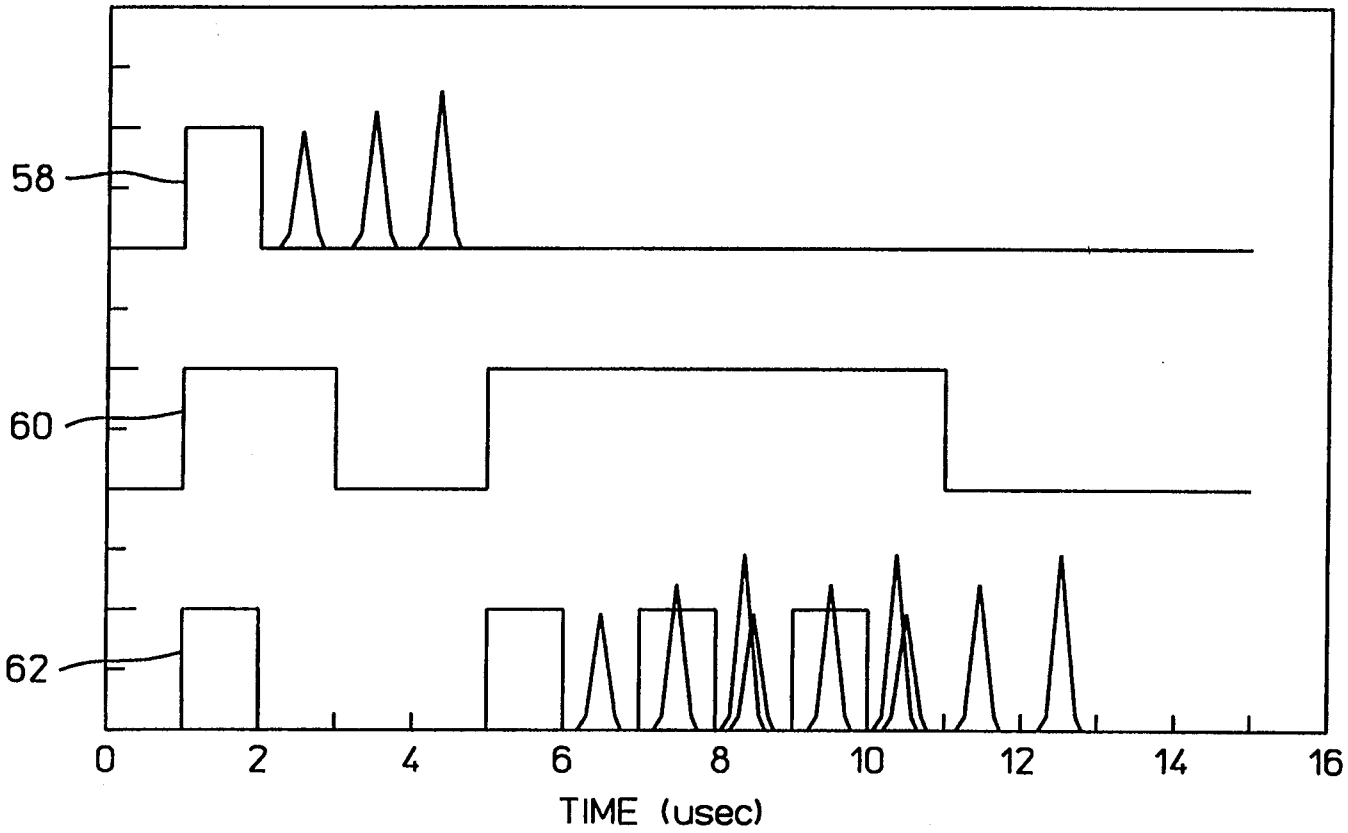
FIG. 4 is a graphical view of alternative extraction pulsing sequences for operating the mass spectrometers of FIGS. 1 and 3.

FIG. 4 illustrates a comparison between the traditional pulse-and-wait approach and the use of pseudo-random noise coding modulation on the extraction pulse to the extraction grid 44 of FIG. 3. The first trace 58 represents the traditional extraction pulse operation, wherein one packet of ions is released from a source and a second packet is released only after a relatively long waiting period to allow all of the ions of the first packet to reach the detector. The output signal from the detector is therefore the three-peak mass spectrum that is shown superimposed on the first trace 58. The second trace 60 is a 7-bit long pseudo-random sequence as it is normally represented in a non-return-to-zero (NRZ) waveform. The third trace 62 is the return-to-zero (RZ) waveform for the same code as the second trace. It is this last waveform that is generated by the pulse time encoder 48 of FIG. 3 when the mass spectrometer 40 is operated in its preferred embodiment. Superimposed on the third trace 62 are the spectra of the individual packets released by the four pulses and detected at the detector. FIG. 3 shows an output signal 64 from the detector 50. The output signal is an accumulation of the overlapping spectra from a propagation path of the mass spectrometer 40. The output signal is then correlated with the encoded sequence generated at the encoder 48 to derive a single non-overlapped spectrum 66. Correlation takes place at a correlator 68. The detector 50 may be of the type well known in the art. The detector may provide an output signal 64 which is either electrical or optical.

The correlator 68 preferably relies on a pseudo-random noise code employed to release ions from the ion source 42. The code used in launching the ions is expressed as a digital array of demodulation processing. The pseudo-random noise code is correlated with the output signal 64 from the ion detector 50 and the results are stored in a separate array. Specifically, correlation is accomplished by multiplying corresponding integer elements of the launch sequence and the output signal 64 with each other and taking the sum of the resultant multiplicands. This establishes a single demodulated data element. The launching sequence and output signal are then shifted in time relative to each other by a predetermined amount to establish a new element-by-element correspondence. Again, the corresponding integer elements are multiplied and the multiplicands are summed to obtain a second demodulated data element. The process is repeated until the non-overlapped spectrum 66 is obtained. To follow is an implementary program in C language, but persons skilled in the art will recognize that there are alternative techniques that achieve the processing in a potentially faster manner.

```
void    correlate(code, data, code_size, data_size)
    int         *code,          /* array of code values    */
                *data,          /* data array              */
                code_size,      /* size of code array      */
                data_size;      /* size of data array      */
{
  int    i, j, k, p, step, sum;        /* declaration of the variables, all integers */
  step = data_size / code_size;        /* always an integer ratio */
  for (j = 0; j < step; j++) {         /* for j varying from 0 to step-1 by 1 */
    /* copy the comb of data points step apart starting at j into buffer */
    for (k = 0; k < code_size; k++) { /* for k varying from 0 to code_size-1 by 1 */
        tmp[k] = data[k*step + j];
    }
    /* perform the product of the code array and the shifted data array */
    /* does it in two chunks because of the wrap-around of the shifted data */
```

-continued

```
    for (p = 0; p < code_size; p++) { /* for p varying from 0 to code_size-1 by 1 */
        sum = 0;
        /*          code |0| . . . |code_size-p-1|  . . .                |code_size-1|
                    data |p| . . . |code_size-p   | XXXXXXXXXXXXXXXXXXXXXXXX      */
        for (i = 0; i < code_size-p; i++) {
            sum += code[i]*tmp[i+p];
        }
        /*          code |0| . . .      |code_size-p| . . .                |code_size-1|
                    data XXXXXXXX|      0     | . . .                     |    p-1    |      */
        for (i = code_size-p ; i < code_size; i++) {
            sum += code[i]*tmp[i+p-code_size];
        }
        data(k*step + p] = sum;
    }
  }
}
```

As previously noted, an advantage of the invention is that the more efficient use of ions increases the sensitivity of the time-of-flight mass spectrometer 40 of FIG. 3. For a traditional pulse-and-wait approach in which the total flight time of the ions of the greatest mass is 256 microseconds, a 1 microsecond extraction pulse yields a duty cycle of only 1:256. However, a pseudo-random noise code having a 127 length and having extraction pulses of 1 microsecond would launch a total of 64 ion packets within a single interval 256 microseconds. The deconvolution algorithm performed according to the invention is effective in producing a single non-overlapped spectrum from the 64 spectra that include overlapping. Notably, the effective duty cycle is 1:4. If the mass spectrometer were limited by the noise of the ion signal, the signal-to-noise ratio of the measurement should increase by a factor of the square root of 64, i.e. a factor of 8.

Another advantage of constructing and operating the time-of-flight mass spectrometer 40 in accordance with the invention is that there is a reduction in the dynamic range demands of the data acquisition operation. In a case in which a sample of interest contains two different ions in the ratio of 1000:1 and the ions are formed in the ion source 42 at a rate of 1001/256 micro-seconds, if all of the ions are stored for 256 microseconds and then released, two signals will arrive at the detector with an intensity ratio of 1000:1 (with the 1 representing a single ion event). If an 8-bit analog-to-digital converter is used to digitize the signal, it can only distinguish 256 signal levels. If the gain of the system were to be set so that the least significant bit of the converter were to be equivalent to one ion arrival, the pulse from the 1000 ion peak would exceed the conversion range of the converter and be clipped. Consequently, the intensity information would be lost. Likewise, if the gain were to be set so that the 1000 ion event would be full scale on the analog-to-digital converter, the single ion event would be equivalent to 25 percent of the least significant bit and would not be measured. On the other hand, by utilizing the modulation technique described above, the total ion population of 1001 ions would be broken up into 64 packets, each containing an average of 15.65 ions. Since ions are quantitized events, this would be 15 or 16 ions from the large peak in each pulse, and one pulse would be an additional ion from the small peak. With the analog-to-digital converter set for 1 least significant bit to detect a single ion event, this signal would easily be measured without challenging the dynamic range of the 8-bit converter. In the absence of noise, the dynamic range of the system would thereby be extended.

Another advantage is that where the modulation occurs by electronic means, rather than a mechanical chopping system, the encoded sequence can be changed quickly and easily, even during the course of one experiment. Yet another advantage is that the time-of-flight mass spectrometer provides the ability to extend the mass range without compromising sensitivity.

We claim:

1. A method of analyzing ions by determining times of flight from a source region to a detection region comprising:

establishing an encoded sequence for launching packets of ions from said source region, including selecting the encoded sequence such that ions launched in adjacent packets overlap prior to reaching the detection region;

launching a plurality of packets of ions in accordance with the encoded sequence along a propagation path from the source region toward the detection region;

bunching ions in each launched packet to compensate for initial space/velocity variations of ions in each launched packet;

detecting the times of arrival of ions to the detection region, thereby obtaining a signal corresponding to overlapping spectra of times of arrival for the launched packets; and correlating the signal with the encoded sequence for launching packets such that a non-overlapped spectrum is derived from the overlapping spectra.

2. The method of claim 1 wherein bunching ions is a step of focusing ions with respect to a plane intersecting said propagation path such that ions in a launched packet arrive substantially simultaneously at the plane.

3. The method of claim 1 wherein launching the plurality of packets is a step of electrically controlling an extraction grid, and the step of establishing the encoded sequence includes generating a signal corresponding to the encoded sequence for input to the extraction grid.

4. The method of claim 3 wherein the step of establishing the encoded sequence includes selecting a pseudo-random noise code.

5. The method of claim 1 wherein launching the plurality of packets is in accordance with establishing the encoded sequence to generate a return-to-zero code of substantially identical durations of non-zero pulses.

6. A method of analyzing ions by determining times of flight comprising:

selecting a pseudo-irregular sequence for launching packets of ions;

releasing packets of ions in response to a binary signal corresponding to the pseudo-irregular sequence such that on-the-fly packets of ions have substantially identical volumes;

electrically affecting each on-the-fly packet of ions such that each on-the-fly packet becomes more compact;

directing the more compact on-the-fly packets through a propagation path along which ions within an on-the-fly packet vary in velocity in accordance with the mass-charge ratios of the ions, selecting said pseudo-irregular sequence including determining a sequence in which ions of at least some on-the-fly packets spatially overtake ions of other on-the-fly packets;

measuring the times of flight of ions through the propagation path, including detecting times of arrival of ions at a detector end of the propagation path and including correlating detections of times of arrival with the pseudo-irregular sequence; and forming a mass spectrum of ions of the released packets in accordance with the correlating of the detections of times of arrival with the pseudo-irregular sequence.

7. The method of claim 6 wherein electrically affecting each on-the-fly packet is a step of space focusing each on-the-fly packet.

8. The method of claim 6 wherein selecting a pseudo-irregular sequence is a step of selecting a pseudo-random noise sequence.

9. The method of claim 6 wherein directing the more compact on-the-fly packets is a step of directing the ions along a field free region to a detector.

10. An apparatus for analyzing ions by determining times of flight comprising:

a source of ions;

signal generation means for generating a pseudo-irregular signal for launching packets of ions;

launching means connected to the generating means for releasing packets of ions from the source in response to the signal generation means;

compact means operatively coupled to the launching means for bunching ions of each packet released by the launching means;

containment means operatively coupled to the compact means for defining an environment in which the ions in the packets follow a propagation path at velocities dependent upon the masses of the ions, said propagation path having sufficient length to allow packets to overlap along the propagation path;

detector means for determining the times of arrival of the ions at an end of the propagation path; and correlation means for correlating the times of arrival with the pseudo-irregular signal to determine a mass spectrum of ions in the packets.

11. The apparatus of claim 10 wherein the signal generation means is a pseudo-random noise generator.

12. The apparatus of claim 10 wherein the containment means includes a field free region for defining the environment.

13. The apparatus of claim 10 wherein the containment means is a mass spectrometer.

14. The apparatus of claim 10 wherein the compact means includes grids effective for space focusing the ions of a packet.

15. The apparatus of claim 10 wherein the detector means is positioned to provide an output signal to the correlation means for correlating, wherein the output signal varies with the intensity of ions reaching the end of the propagation path.

* * * * *